United States Patent [19]

Boujet

[11] 4,320,367

[45] Mar. 16, 1982

[54] HYPERFREQUENCY FILTER

[75] Inventor: Jean-Pierre Boujet, Chatillon, France

[73] Assignee: Compagnie Industrielle des Telecommunications Cit-Alcatel, Paris, France

[21] Appl. No.: 134,734

[22] Filed: Mar. 27, 1980

[30] Foreign Application Priority Data

Mar. 29, 1979 [FR] France ..... 79 07887

[51] Int. Cl.[3] ..... H01P 1/208

[52] U.S. Cl. ..... 333/209; 333/212

[58] Field of Search ..... 333/202, 208–212

[56] References Cited

U.S. PATENT DOCUMENTS

| | | | |
|---|---|---|---|
| 2,540,488 | 2/1951 | Mumford | 333/209 |
| 3,130,380 | 4/1964 | Bowman | 333/212 |
| 3,153,208 | 10/1964 | Riblet | 333/212 |
| 3,617,956 | 11/1971 | Bastikar | 333/212 |

FOREIGN PATENT DOCUMENTS

| | | |
|---|---|---|
| 1050127 | 3/1979 | Canada . |
| 2326077 | 4/1977 | France . |

*Primary Examiner*—Marvin L. Nussbaum

*Attorney, Agent, or Firm*—Sughrue, Mion, Zinn, Macpeak and Seas

[57] ABSTRACT

A hyperfrequency filter comprises a series connection of an inlet length of waveguide (1), a plurality n of resonant cavities (3, 4, 5) and an outlet length of waveguide (2). All these units are of rectangular cross-section and they are interconnected by coupling irises (16, 17, 18, 19). Each resonant cavity includes a dielectric tuning screw (13, 14, 15) for adjusting the resonant frequency of the cavity. Each tuning screw is located in the middle of one of the largest faces of its resonant cavity.

The longer dimension a of the cross-section of each cavity is longer than the longer dimension of the cross-section of the waveguide lengths so that the optimum width of the coupling irises is substantially at its minimum possible value for a given set of design conditions on the other filter parameters. This has the effect of broadening the range of frequencies over which a given structure can be tuned without detrimental repercussions on the frequency characteristic of the filter.

1 Claim, 3 Drawing Figures

HYPERFREQUENCY FILTER

FIELD OF THE INVENTION

The present invention relates to hyperfrequency filters, and in particular to filters made of lengths of rectangular section waveguide.

BACKGROUND OF THE INVENTION

The most usual bandpass filters made from rectangular section waveguide are constituted by a series of resonant cavities each cavity having a length about λ go/2, where λ go is the length of the guided wave at the center frequency Fo of the filter. The first and last cavities are each connected to a respective length of standard inlet or outlet waveguide. Coupling between the successive resonant cavities, and between the end cavities and the lengths of inlet or outlet waveguide is performed by coupling irises. In known arrangements, such filters have a linear structure obtained by inserting obstacles into a rectangular section waveguide to partition the wave guide longitudinally into portions whose lengths are about λ go/2, or a multiple thereof. These portions constitute the resonant cavities which are interconnected in series and with the inlet and outlet lengths of waveguide via coupling apertures or irises in the obstacles. The dimensions of the rectangular cross-section of the waveguide are standardised as a function of the type of filter to be obtained and in terms of the desired center frequency Fo and bandwidth.

Such filters are reversible, that is to say either one of the end lengths of waveguide may be used as the inlet, with the other being used as the outlet. Such filters may be designed using the methods explained in "Microwave filters, Impedance matching networks, and Coupling structures" by G. L. Matthaei, L. Young, and E. M. T. Jones, published by the McGraw-Hill Book Company, New York, with particular reference to pages 434, 450, 461, 463, and 234.

Bandpass filters are particularly used in filtering assemblies where the center frequencies of the various filters are shifted with respect to each other according to the frequency channels they are to combine, i.e. assemble or separate.

In this type of application, it is known to use bandpass filters of adjustable center frequency. One known solution for providing filters of adjustable center frequency is given by U.S. Pat. No. 3,130,380 in the name of David F. Bowman. This specification describes cavities which are all of the same width λ g/2, said width being delimited by the distance between a pair of pistons. The resonant frequency of the cavities is set by varying the distance between each pair of pistons, while coupling variations are obtained by shifting the pistons in pairs to provide different off-sets for the inlet and outlet coupling irises with respect to the different cavities. The dimensions of the coupling irises can also be varied to help improve the filter characteristics.

Preferred elbodiments of the present invention provide a bandpass filter with a defined filter characteristic that can be shifted over a wide range of frequencies with very little variation in the said frequency characteristic. This can be obtained without modifying the mechanical structure of the filter and without modifying the positions and/or sizes of the coupling irises.

SUMMARY OF THE INVENTION

The present invention provides a hyperfrequency filter comprising a series connection of an inlet length of waveguide, a plurality n of resonant cavities, and an outlet length of waveguide. The lengths of waveguide and said resonant cavities being of rectangular cross-section and being interconnected by coupling irises. Each resonant cavitiy includes a dielectric tuning screw located in one of the largest faces of the cavity and serving to adjust the resonant frequency of the cavity. The optimum width i of each coupling iris is a function of the length $a_c$ ($1 \leqq c \leqq n$) of the longer dimension of the cross-section of the resonant cavity (for other design parameters remaining constant), said function exhibiting a minimum value of optimum width i for some value of $a_c$, wherein each length $a_c$ is longer than the longer side of the cross-section of said lengths of inlet and outlet waveguide, and is chosen to have a value such that the corresponding optimum width i for each coupling iris is substantially equal to the said minimum value, and wherein the width of each coupling iris is, in fact, substantially equal to said minimum optimum width.

In such a filter, the passband is shifted solely by adjusting tuned frequency of each cavity.

An embodiment of the invention is described by way of example with reference to the accompanying drawings.

DESCRIPTION OF THE PREFERRED EMBODIMENT

Figure 1:
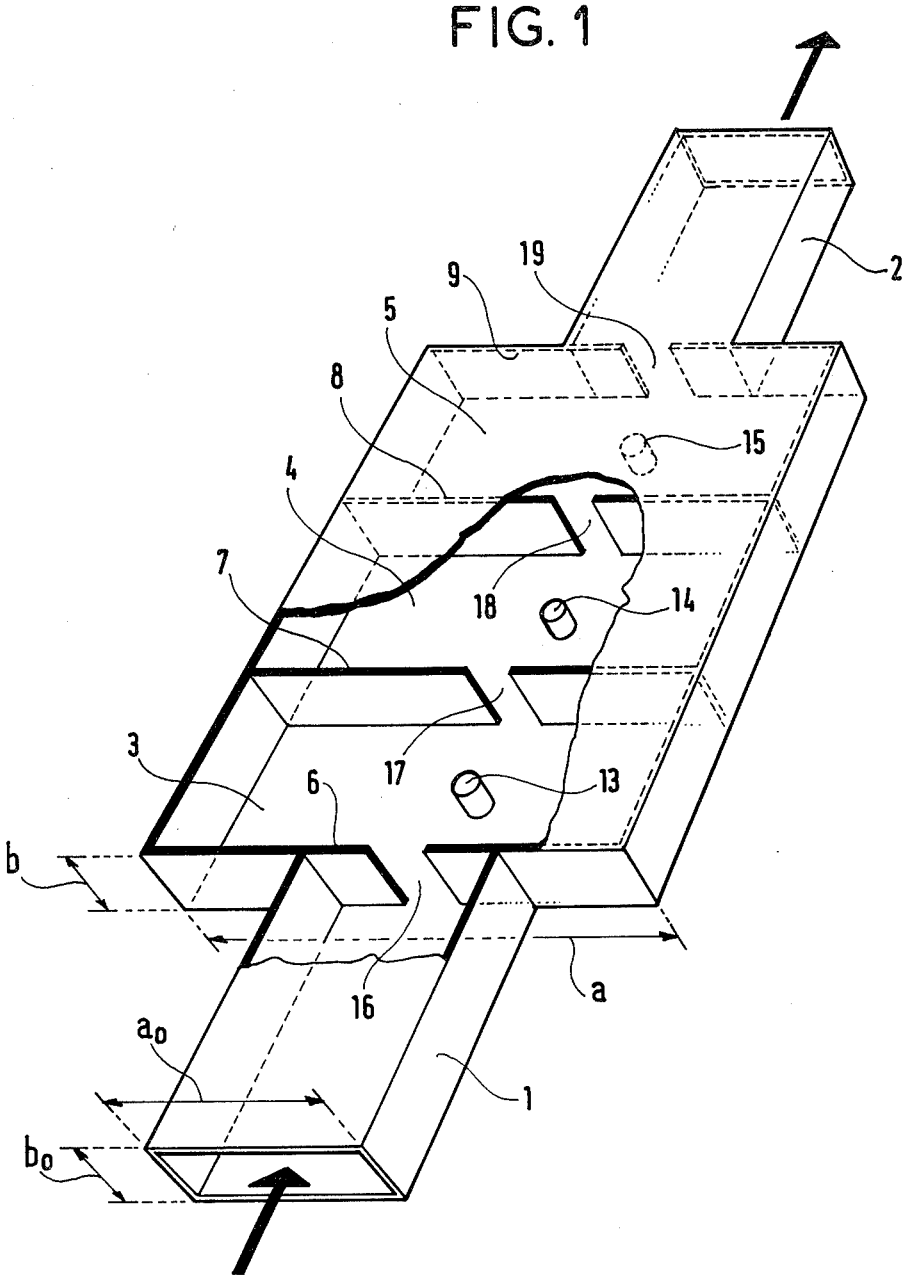
FIG. 1 is a partially cut away perspective view of a filter in accordance with the invention.

In FIG. 1, a bandpass filter comprises an inlet length of waveguide 1, three resonant cavities 3, 4, and 5 and an outlet length of waveguide 2. The inlet and outlet lengths of waveguide 1 and 2 are of rectangular cross-section with a longer dimension $a_o$ and a shorter dimension $b_o$. They propagate electromagnetic waves in rectangular $TE_{10}$ mode. The three resonant cavities 3, 4, and 5 are identical to each other and shave a common longitudinal axis with the lengths of inlet and outlet waveguide. The resonant cavities are obtained from a length of rectangular section waveguide, having a larger dimension a, where $a > a_o$, and a shorter dimension b, where $b = b_o$. The cavities are separated from each other and closed at the ends of the series connection by inductive obstacles 6, 7, 8, and 9. These inductive obstacles are pierced by coupling irises 16, 17, 18, and 19 respectively. In this particular filter the coupling irises are rectangular, but other forms could also be used. The obstacles are separated from each other by a distance of about λ go/2, where λ go is the guided wavelength at the centre frequency Fo of the filter.

Each of the resonant cavities has a dielectric screw 13, 14, or 15 as the case may be, mounted in one of its largest faces and projecting into the cavity by a distance which can be varied in order to adjust the electrical length of the cavity and to make corrections for temperature variation.

Parasitic passbands stem principally from parasitic resonances in the cavities which occur when the guided wavelength λ g is about ½(λ go/2), and also at the resonant frequencies of the coupling irises. Ideally, capacitive irises should be used since they have a high resonant frequency, but in filters with a relative passband of a few percent, such irises are too small and difficult to construct satisfactorily. Inductive coupling irises have thus been used and an attempt is made to reduce their size in order to shift their resonant frequencies as high as possible. Further, the filter cavities are considerably over-dimensioned along the longer dimension of their rectangular cross-section, thereby forming rectangular $TE_{101}$ mode cavities. In contrast to what might have been expected, this does not cause higher parasitic modes to be excited. However, since the length λ g of the guided wave is related to the length λ of the same wave in air by the equation:

$$\lambda g = \frac{\lambda}{\sqrt{1 - (\lambda/2a)^2}}$$

λ g tends to approach λ, causing the first parasitic passband, which occurs when the cavity wavelength λ g is about ½(λ go/2), to be shifted up in frequency.

The coupling irises 16 to 19 for the cavities which are over-dimensioned with respect to the inlet and outlet waveguides, themselves have dimensions chosen as a function of the longer dimension a of the cross-section of the cavities. The width of the irises (or the diameter of a circular iris) together with the cavity dimension a constitute an inter-related pair of parameters. In other words under a given set of conditions, there is an optimum value iris width i for any given value of the dimension a. When a graph is plotted of optimum values of i against different values of a (see FIG. 2) the value of i is seen to pass through fairly flat minimum. In accordance with the present invention, the values of a and i are chosen such that i is close to the minimum optimum value for some given set of circumstances. Experiments and tests conducted by the Applicant have shown that this helps shift parasitic passbands up in frequency and, particularly, that the center frequency of the filter characteristic can itself then be shifted by varying the position of the dielectric screws 13, 14 & 15 without it being necessary to change any other dimension of the filter, and without altering the shape of the filter characteristic. In other words, Applicant has established that for a given structure, and hence fixed a and fixed i, the fixed values of a and i remain good over a range of frequencies determined by the tuning screws, provided that the chosen value of i is near to the minimum value. This property is most advantageous, in particular because the irises are situated in regions where the electromagnetic current is particularly high.

Figure 2:
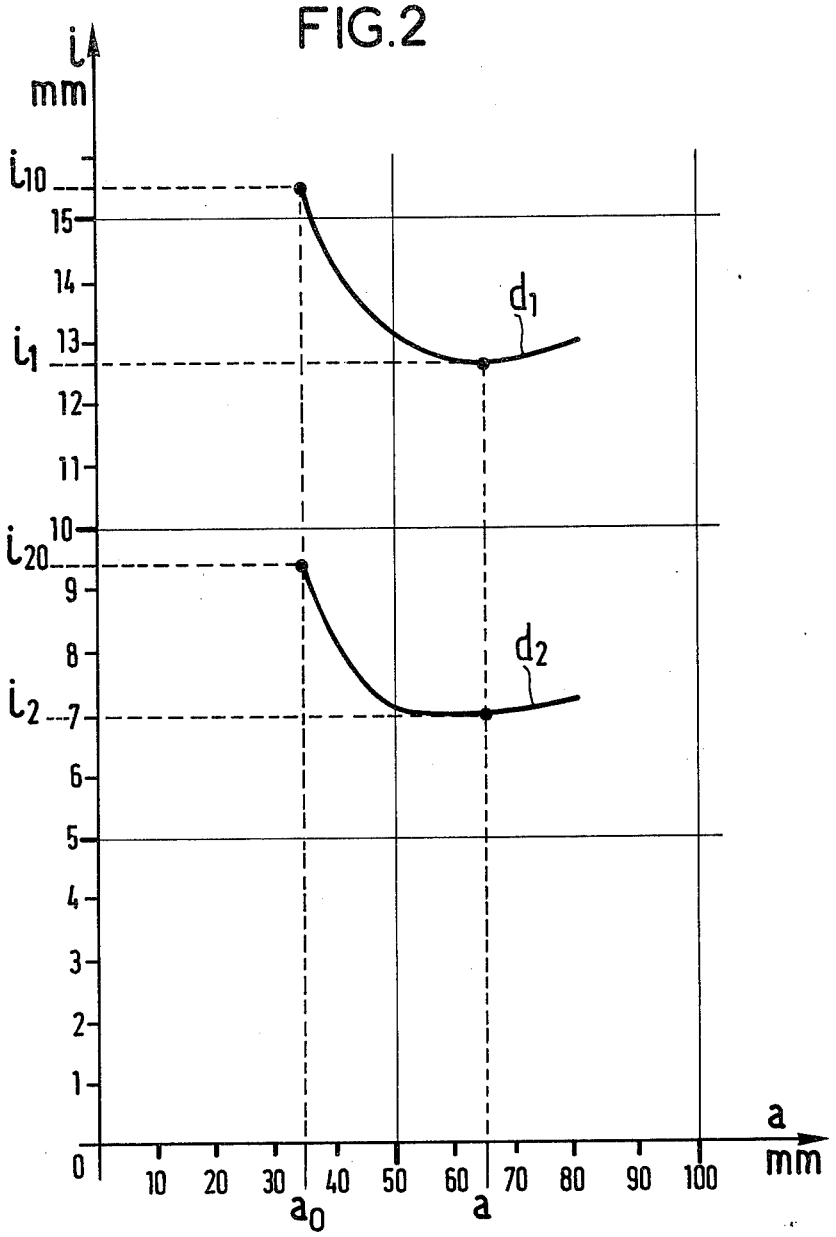
FIG. 2 is a graph showing two curves explaining the choice of length for the longer side of the cavities and of the coupling irises in a bandpass filter of variable center frequency as shown in FIG. 1.

FIG. 2 shows the variation in iris width i as a function of different values of the dimension a for a filter having a center frequency Fo=5.9 GHz and a passband of 38 MHz. In FIG. 2, the curve $d_1$ shows the variation of $i_1$ of the irises 16 & 19 which provide coupling between the inlet length of waveguide 1 or the outlet length of waveguide 2 and the adjacent resonant cavity, while the curve $d_2$ shows the variation in the width $i_2$ of the irises 17 & 18 which provide coupling between adjacent resonant cavities. Both these curves are given as a function of the dimension a. For this particular filter the chosen values of a, $i_1$ & $i_2$ are as follows:

$$a=65 \text{ mm}, i_1=12.77 \text{ mm}, i_2=7 \text{ mm}.$$

In a conventionally designed filter, having the same center frequency Fo=5.9 GHz and the same passband of 38 MHz, each resonant cavity would have the same cross-section as the lengths of inlet and outlet waveguide, namely:

$$a_o=34.85 \text{ mm}, b_o=15.80 \text{ mm}.$$

Under such circumstances the iris dimensions corresponding to the value $a_o$=34.85 mm are as follows:

$$i_{10}=15.53 \text{ mm}, i_{20}=9.41 \text{ mm}.$$

Now, if the filter in accordance with the invention as described abouve has its center frequency Fo changed to 6.4 GHz, while keeping a 38 MHz passband and retaining the following dimensions:

$$a_o=34.85 \text{ mm}, b_o=15.80 \text{ mm}, \& \ a=65 \text{ mm},$$

calculations on the same lines as those performed above show that the optimum values of $i_1$ and $i_2$ are as follows:

$$i_1=12.15 \text{ mm}, \& \ i_2=6.53 \text{ mm}.$$

The small differences in optimum iris width, $\Delta i_1 \simeq 0.6$ mm and $\Delta i_2=0.47$ mm, show that there is very little difference between the optimum coupling for a filter having a center frequency of 5.9 GHz and for one having a centre frequency of 6.4 GHz. This means that it is possible to specify a filter having a center frequency of 6.4 GHz, for example, and then to shift its filter characteristic to a center frequency of 5.9 GHz merely by acting on the tuning screws in the middles of the cavities and without modifying the coupling irises. In such a case, the filter characteristic shown by a solid line in FIG. 3 can be seen to vary very little as it is shifted, and in particular its bandwidth and its in-band loss vary very little from one position to the other.

Figure 3:
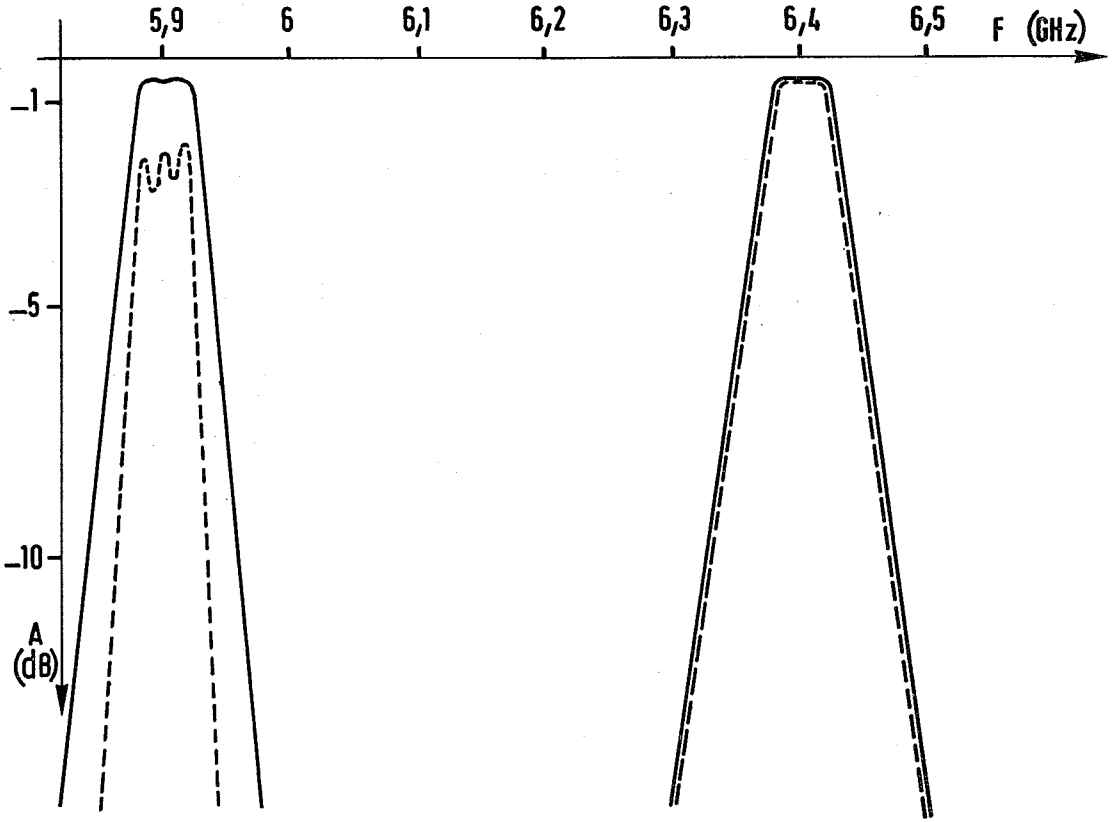
FIG. 3 is a plot which shows the filter characteristics of a narrow band filter designed on the basis of the curves shown in FIG. 2 and of a filter designed using a prior art method.

Performing a similar operation on a conventional filter whose resonant cavities are of the same cross-section as the inlet and outlet lengths of wavguide, gives rise to the result shown in dashed lines in FIG. 3. Both filters have the same performance at their design frequency of 6.4 GHz, but the conventional filter has a more ragged passband with higher overall attenuation at the lower frequency of 5.9 GHz. This undesirable phenomenon arises because the optimum iris widths at the two frequencies for the conventionally designed filter differ by about 1.7 mm, i.e. $\Delta i_{10} \simeq \Delta i_{20} \simeq 1.7$ mm. This makes it esential to adjust the iris width when adjusting frequency if severe distortion of the filter characteristic is to be avoided.

The filters which have been described can be used in filtering arrangements in conjunction with a circulator or with −3 dB hybrid couplers as described in the Applicant's published French patent No. 2,346,868.

I claim:

1. A hyperfrequency filter comprising a series connection of an inlet length of waveguide, a plurality n of resonant cavities, and an outlet length of waveguide, said lengths of waveguide and said resonant cavities being of rectangular cross-section, having longer and shorter sides, and being interconnected by coupling irises, each resonant cavity including a dielectric tuning screw located in one of the longest faces of the cavity and serving to adjust the resonant frequency of the cavity, the improvement wherein:

the optimum width i of each coupling iris being a function of the length $a_c$ wherein $a_c$ designates the length of the large side of each resonant cavity of a row of such resnonant cavities;

and wherein with other design parameters remaining constant, said filter exhibits a minimum value of optimum width i for some value of $a_c$, each length $a_c$ is longer than the longer side of the cross-section of said inlet and outlet waveguide lengths and is chosen to have a value such that the corresponding optimum width i for each coupling iris is substantially equal to said minimum value, and wherein the width of each coupling iris is, in fact, substantially equal to said minimum optimum width;

whereby, the filter may be shifted over a wide range of frequencies with very little variation in the frequency characteristic solely by adjusting the dielectric turning screws.

* * * * *